US006212284B1

(12) United States Patent
Puls

(10) Patent No.: US 6,212,284 B1
(45) Date of Patent: Apr. 3, 2001

(54) SOUND REPRODUCTION DEVICE

(75) Inventor: Bernhard Puls, Mitterfels (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 0 days.

(21) Appl. No.: 09/128,654

(22) Filed: Aug. 4, 1998

(30) Foreign Application Priority Data

Aug. 7, 1997 (DE) ..... 197 34 120

(51) Int. Cl.[7] ..... H04R 25/00

(52) U.S. Cl. ..... 381/345; 381/349; 381/182; 381/338

(58) Field of Search ..... 381/87, 89, 332, 381/345, 349, 351, 386, 182, 186, FOR 145, FOR 146, 124; 181/144, 145, 155, 156, 199, 160, 185, 189

(56) References Cited

U.S. PATENT DOCUMENTS 3,912,865 * 10/1975 Seebinger ..... 381/124
4,783,820 * 11/1988 Lyngdorf et al. ..... 381/39
6,021,208 * 2/2000 Kin-Lung ..... 381/338

FOREIGN PATENT DOCUMENTS 3902434 8/1980 (DE) .
19507296 9/1995 (DE) .
0669781 2/1994 (EP) .
4336794 11/1992 (JP) .
5284586 10/1993 (JP) .
6233367 * 8/1994 (JP) ..... 381/FOR 146

OTHER PUBLICATIONS

"Vented–Box Loudspeaker Systems Part I: Small–Signal Analysis" by Richard H. Small Jun. 1973, vol. 21, No. 5 of Journal of the Audio Engineering SCC, pp. 363–372.

* cited by examiner

*Primary Examiner*—Huyen Le
(74) *Attorney, Agent, or Firm*—Ware, Fressola, Van Der Sluys & Adolphson LLP

(57) ABSTRACT

According to the invention, a bass reproduction device is disclosed, with which the sound emission from the membrane (15) to the listening space (38) is carried out solely by way of a displacement volume (37) and at least one sound guidance conduit (34), whose cross section is smaller than the cross section of the membrane (15). A device of this kind has the advantage that for sound emission, only wall surfaces have to be supplied, which merely have to contain the sound guidance conduit(s) (34). The side of the membrane (15) remote from the displacement volume (37) acts on a closed damping volume (30), which can, however, be changed in its size over a great band width. A particularly favorable bass reproduction is achieved if the length of the respective sound guidance conduit (34)$\leqq\lambda/8$ of the desired upper cross-over frequency.

11 Claims, 4 Drawing Sheets

SOUND REPRODUCTION DEVICE

TECHNICAL FIELD

The subject of the invention is a sound reproduction device, in particular such a device for reproducing low-frequency sounds.

BACKGROUND OF THE INVENTION

According to the prior art, it is known to reproduce audio signals by means of so-called electroacoustic converters. As main components, converters of this kind have a membrane, a drive device, and fastening means for reciprocal connection of the membrane and the drive device. Drive devices for a membrane of this kind are predominantly constituted by a magnet system which has a permanent magnet and a yoke (also called a back iron). The membrane is provided with an oscillator coil and dips into an air gap left in the magnet system. If both ends of the oscillator coil are conductively connected to an audio signal source, the oscillator coil moves in the air gap of the magnet system so that air volumes adjacent to the respective surfaces of the membrane are set into oscillations by way of the membrane connected to the oscillator coil. Since a device of this kind is not suited to satisfactorily reproduce the entire audible frequency band of an audio signal source, development has therefore been switched over to so-called range converters, which are constituted so that they are optimized for only a partial region of the frequency band to be transmitted. As a rule, devices currently in actual use have a converter for low, middle, and high-frequency audio signals. In devices of this kind, the two converters for middle and high-frequency audio signals may also be replace by only one converter. In order to further improve the transmission of low-frequency audio signals, the attempts began quite early to incorporate converters, which were intended for transmitting low-frequency audio signals, into housings in order to prevent obliterations of sound waves which are emitted by the front and back sides of the membrane. In this connection, essentially three basic forms have been produced.

The first basic form, which is also called a closed housing, is distinguished by virtue of the fact that the housing, with the exception of the converter opening in which a converter is mounted, has no other opening. However, the air volume, which is enclosed in the housing and communicates with the back side of the membrane, acts as an additional spring, by means of which the resonance frequency of the converter is increased and consequently the lower cut-off frequency is shifted to higher frequencies. So that sufficiently low sounds can be emitted using devices of this kind, the enclosed air volume, which is also called the damping volume, is not permitted to fall below a minimum value. In devices of this kind, it is disadvantageous that the housing must have at least one wall oriented toward the listening space, which wall, based on its dimensions, is suited to receive the usually large-dimensioned bass converter in the opening. When the space or area requirements of such devices are taken into consideration, these devices cannot be used in applications that also demand a favorable bass reproduction even when there is only a small amount of space available (for example in a motor vehicle).

Bass reflex boxes, which constitute the second basic form, are constructed on the same principle as the first basic form. In contrast to this principle, though, bass reflex boxes have an additional opening in the housing, from which the sound waves emitted backwards from the membrane emerge in-phase with the sound waves emitted from the front side of the membrane and support their action. In bass reflex boxes, the converter and the housing constitute two systems coupled to each other. The bass reflex housing is a resonator whose resonance frequency, which depends on the volume of the housing and the size and depth of the additional opening, is modulated to the natural frequency of the installed bass converter. As a result of this, oscillations of coupled circuits set in. Sounds that are close to the natural resonance of the installed converter excite the gas volume in the housing (disposed in resonance) into particularly powerful sympathetic oscillation. The low coupling frequency that occurs in this connection brings about the fact that bass sounds that can only be weakly transmitted by a converter disposed in a closed housing become audible in an amplified manner.

With bass reflex devices, even if the sound pressure frequency response is not so linear in contrast to closed housing devices, bass reflex devices have the advantage over the closed housing devices that with smaller dimensions, they provide a higher efficiency at low frequencies. However, like closed housing devices, bass reflex devices have the general disadvantage that the converters must be inserted into a wall of the (bass reflex) housing, which rules out a large number of application fields even for these devices (in particular those with a small amount of space available).

For the time being, the so-called band-pass devices represent the end point of box development and at the same time, constitute the third basic form. Band-pass devices are distinguished by virtue of the fact that a closed housing is divided into two chambers by means of a dividing wall. The bass converter is inserted into this dividing wall. In the simplest design, band-pass devices have a bass reflex opening in one of the two chambers and this bass reflex opening is solely responsible for the transmission of sound. The basis for these devices, which demonstrate a very favorable bass reproduction behavior, is the use of the particular frequency response character of a Helmholtz resonator: this device, which is comprised of a hollow chamber with an opening of a particular length and a particular cross section, when excited by means of a converter, demonstrates a frequency response with a distinct resonance frequency at which the sound pressure is maximal and with trailing edges that have an inclination of 12 decibels per octave at lower and higher frequencies. At higher frequencies, however, an additional parasitic effect occurs, which should be compared to the behavior of a transmission line device at the earliest possible time: in the opening of the Helmholtz resonator, standing waves are formed, whose fundamental oscillation has a wavelength of twice the length of the opening. This effect can, however, be prevented through the use of electrical filters.

It is characteristic for the band-pass devices that the volume that is open—because it is provided with the bass reflex opening—requires a chamber volume which, depending on the embodiment, requires between approximately 0.4 and 0.8 of the chamber volume of the volume that is closed—for this consideration. As long as the corresponding volumes are provided, the shape of the different chambers is to a large extent arbitrary. If one also considers the fact that merely for the emergence of sound, band-pass devices require walls that are slightly bigger than the cross section of the bass reflex opening and that otherwise, such devices already permit an acceptable bass reproduction at approximately 10 to 12 liters of total volume, then these devices are also suitable for uses in which there is only a very limited amount of available space. However, if one includes in the consideration the fact that in many intended uses, the limited space available for containing bass reflex devices can also be subjected to a large number of changes, this means that since bass reflex devices react very sensitively to reductions in the total volume, a large number of band-pass devices must called into question due to the space changes.

To explain it in connection with an example: if one assumes that with the so-called standard equipment, the required amount of space for the installation of a bass reproduction device is available under the driver's seat of a passenger vehicle, then, for example when the vehicle is equipped with an electrical seat adjustment, this volume can become no longer available as a result of the required servomotors or can exist only in an altered form. The same is true if the vehicle can be furnished with a spoil seat, for example. When dimensioning a bass reproduction device, even if equipment variants of this kind can be taken into account in the conception of bass reproduction devices, at some point, the time comes when changes (=reductions) in the housing shape or in the bass reproduction device become necessary. In this connection, emphasis need only be placed on the case in which, starting based on a limousine, combination or all-wheel versions are developed (over time), with an altered undercarriage and for the stability of the vehicle, the space under the seats is reduced, for example as a result of reinforcing beads.

Therefore, the object of the invention is to disclose a sound reproduction device for reproducing low-frequency sounds which can very flexibly use an existing available space even when there are changes in this available space and furthermore only requires one sound emission opening to the listening space and the cross sectional area of this opening is smaller than that of the membrane.

SUMMARY OF THE INVENTION

This object is attained by a sound reproduction device with a first membrane for reproducing low-frequency sounds, which has two surfaces, with a drive device, which drives at least the first membrane and is disposed spaced axially apart from it, with fastening means for the reciprocal connection of the first membrane and the drive device, with two displacement volumes, which are disposed in front of the two surfaces, and with a closed damping volume, which is constituted by walls of a housing and the first membrane, wherein the displacement volume, which adjoins the surface of the first membrane remote from the damping volume, is closed except for at least one opening, the cross sectional area of all of the openings is significantly smaller than the cross sectional area of the first membrane, and an open sound guidance conduit adjoins each opening and its cross section corresponds essentially to the cross sectional area of the opening to which it is connected. If the surface of the (first) membrane, which is remote from the closed damping volume, acts exclusively on the displacement volume, which is embodied as very small and is closed except for one opening, a very favorable bass reproduction can be achieved, even with a variable available space, when the cross sectional areas of all of the openings are significantly smaller than the cross sectional area of the first membrane and an open sound guidance conduit adjoins each of the openings, and the cross section of this conduit essentially corresponds to the cross sectional area of the opening to which it is connected. The variability of such a device for bass reproduction is based on the fact that on the one hand, the displacement volume including the sound guidance conduits is very small and that with greater band width, the damping volume reacts non-critically to volume changes.

The favorable reproduction behavior can best be explained by means of coustic analogies or electrical equivalent circuit diagrams (in this connection, see R. Small, "Vented Box Loudspeaker Systems" AESJ, June 1973, starting on p. 363). According to this, it turns out that in bass reflex boxes, the two reactive components of the speaker (=mass and flexibility) are supplemented by two additional reactive components, the flexibility of the housing volume and the acoustic mass of the bass reflex tube (also called the port). From the acoustic analogy or the electrical equivalent circuit diagram, it becomes clear that three resonance frequencies occur in devices of this kind.

In contrast to this, with a closed housing a flexibility is produced, which results from the flexibility of the speaker suspension devices and the flexibility of the housing volume, and this resulting flexibility is less than the flexibility of the freely mounted speaker. With a freely mounted speaker, this produces only a single resonance frequency which has a higher value, however, in comparison to the mounted speaker.

In contrast to this, the device according to the invention works directly on the acoustic mass which is supplied by the sound guidance conduit(s) since the displacement volume does not function as a housing volume in this respect, due to its small size. In other words, the device according to the invention has a similar equivalent circuit diagram to the closed box, but with the difference that in the system according to the invention, the reactive component of the speaker is not supplemented by the flexibility of the housing, but is only supplemented by the acoustic mass of the sound guidance conduit(s). This means that the acoustic mass of the sound guidance conduit, together with the moving mass of the speaker, constitutes a resulting mass that is greater than the acoustic mass of the speaker. The result is that only one resonance frequency occurs since there are only two reactive components and that this (new) resonance frequency is lower than the resonance frequency of a freely mounted speaker.

For the sake of better comprehension of the application, it should merely be emphasized at this point that the displacement volume mentioned several times in the application is the volume which must be supplied by a converter so that the (first) membrane can move on one side at the maximal stroke within the structural conditions of the speaker, without there being the danger that the oscillating palts of the converter "strike against" pairs of the converter that are not oscillating. If, for example, the (first) membrane is a conical membrane of the kind indicated in German Utility Model 9109452, then the displacement volume that is present on the surface of the membrane remote from the magnet system, is essentially constituted by the effective membrane diameter and the volume between the upper edge of the membrane and the upper edge of the converter. With German Utility Model 9109452, if one assumes that the stabilizing elements labeled with nineteen there and the centering membrane are air permeable, then the (rear) displacement volume that adjoins the surface of the membrane oriented toward the magnet system is constituted in the space which is essentially defined by the surface of the membrane just mentioned, the oscillator coil support, and the holder of the converter.

In this connection, merely for the sake of completeness, it should be emphasized that for a favorable bass reproduction, it is sufficient if, when a maximal deflection of the membrane to one side is considered, the displacement volume is subject to the following equation:

$$\text{displacement volume} <= \text{effective membrane diameter}^3 \times 0.06$$

Since according to the above explanations, the device according to the invention is intended to work directly on the acoustic mass supplied by the sound guidance conduit(s), the reduction of the factor indicated with 0.06 in the above formula acts to realize these conditions.

There is a particularly favorable bass reproduction when the length of the sound guidance conduit(s)$\leqq\lambda/8$ of the desired upper cross-over frequency. If there is another membrane and it is disposed spaced axially apart from the first membrane, and there is the drive device that drives the additional membrane, a very compact device for sound reproduction with separate range converters is produced, in which, in contrast to other known coaxial devices that have an additional membrane and a magnet system in the sound cone of the first membrane, the additional membrane has no influence on the sound emission by the first membrane thanks to the sound guidance conduits.

If there is another closed damping volume and if this damping volume is constituted by the additional membrane and by walls of a housing, the additional membrane can be used for the reproduction of middle or middle/high-frequency audio signals without increasing the total space requirement of a device.

There is a very economical use of building materials when the sound guidance conduits are constituted at least partially of walls of the additional housing.

Overheating of the drive device is prevented if the wall surfaces of the drive system interchange with the gas volume of the listening space by way of the sound guidance conduits.

The present invention can be configured so that the drive device for each of the two membranes has an independent magnet system that has a permanent magnet and a yoke, so that the two magnet systems are connected to each other back-to-back. In this configuration each membrane, together with the magnet system that drives it, constitutes a converter of the type indicated in German Utility Model 9109452. This means that each of the two converters according to the invention can be largely comprised of components that are standardized and are also used, for example, in devices according to German Utility Model 9109452. The large-scale elimination of the requirement to use separate components in the system according to the application also has the further advantage that the two converters that constitute a system according to the application can be pre-made on manufacturing devices that are also used, for example, to produce converters according to German Utility Model 9109452.

BEST MODE FOR CARRYING OUT THE INVENTION

The invention will now be explained in more detail in conjunction with the Figs.

Figure 1:
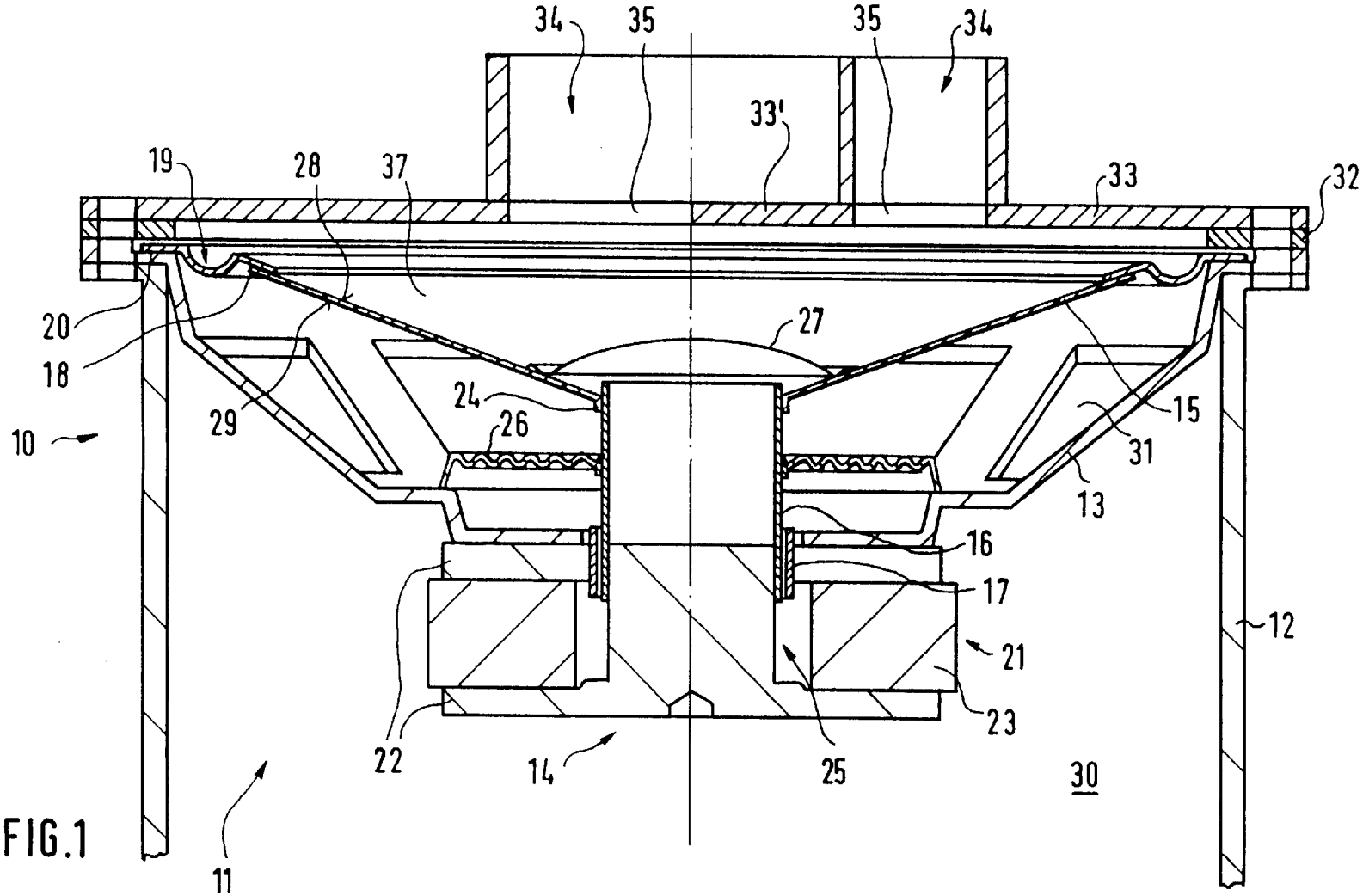
FIG. 1 is a section thorough a sound reproduction device.

FIG. 1, which like the other figures, shows no scale reproduction of the actual proportions, shows a bass reproduction device 10. This device 10 is essentially comprised of an electroacoustic converter 11 and a closed housing 12.

As essential components, the converter 11 has a holder 13, a drive device 14, a conical membrane 15, and an oscillator coil 17 disposed on an oscillator coil support 16.

The conical membrane 15 is inserted into the holder 13 and connected. This connection is realized so that the membrane edge 18, which has the greatest radial distance from the central axis of the speaker is connected to the upper edge 20 of the holder 13 by means of a bead 19 that is embodied as groove-shaped. The drive device 14 here constitutes a magnet system 21, which includes a permanent magnet 23 and a yoke 22 comprised of different parts. The lower edge 24 of the membrane 15 is connected to the oscillator coil support 16. If the converter 11 is mounted, as in the state shown in FIG. 1, the oscillator coil 17 dips into an air gap 25 left in the magnet system 21. In addition, there is also a centering membrane 26, which connects the oscillator coil support 16 to the holder 13, and a spherical dust protection cap 27, which spans across the oscillator coil support 6.

In a converter 11 that has just been described, if the ends of the oscillator coil 17 are conductively connected to an acoustic signal source, then the membrane 15 is set into oscillations axial to the central axis of the speaker as a function of the voltages supplied by the audio signal source (not all shown in FIG. 1), so that sound waves are emitted by both the front side 28 and the back side 29 of the membrane 15.

So that a reciprocal obliteration does not occur between sound waves which are emitted by the front side 28 and the back side 29 of the membrane 15, the converter 11 is inserted into a housing 12 so that when the converter 11 is inserted in the housing 12, the housing 12 is closed and in this state, the damping volume 30 is simultaneously formed. Merely for the sake of completeness, it should be emphasized that for technical reasons of depiction, the fully closed nature of the damping volume 30 is not shown in FIG. 1. Even if the holder 13 is connected to the housing 12 in the exemplary embodiment mentioned here, when one considers the through openings 31 in the holder 13, one speaks of the fact that the membrane 15, which largely covers the opening of the housing 12, closes the housing 12.

A spacer ring 32 is placed on the upper edge 20 of the holder 13. Furthermore, the cross section edged by the spacing ring 32 is largely covered by a cap 33. Up to this point in the description of the device 10, the regions of the device 10 shown in FIG. 1 that are disposed on both sides of the central axis of the speaker are embodied identically. However, this no longer applies to the sound guidance conduits 34, which extend in the direction of the central axis of the speaker and are connected to the openings 35 left in the cap 33.

Figure 2:
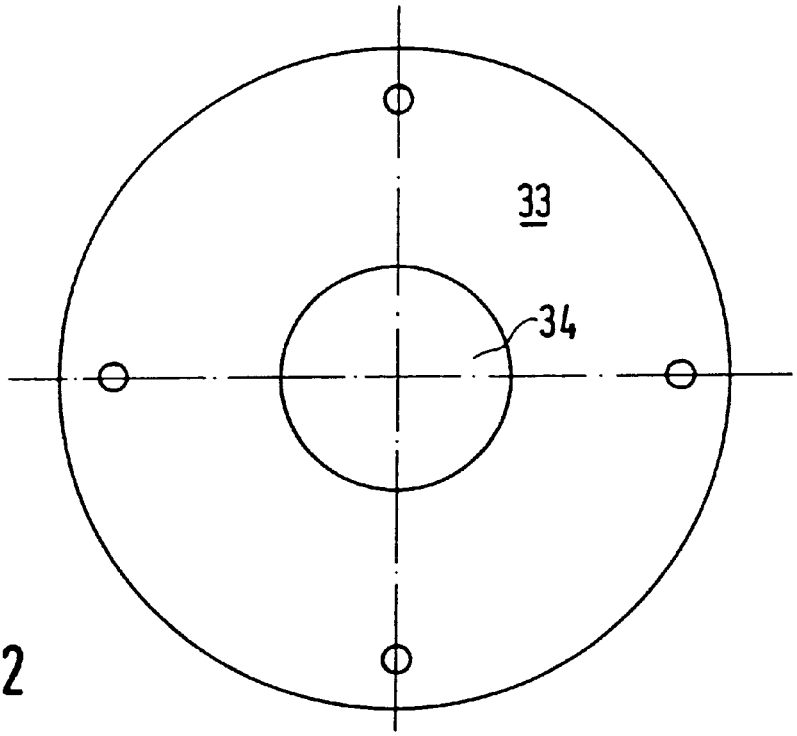
FIG. 2 is a top view of a device according to FIG. 1.
Figure 3:
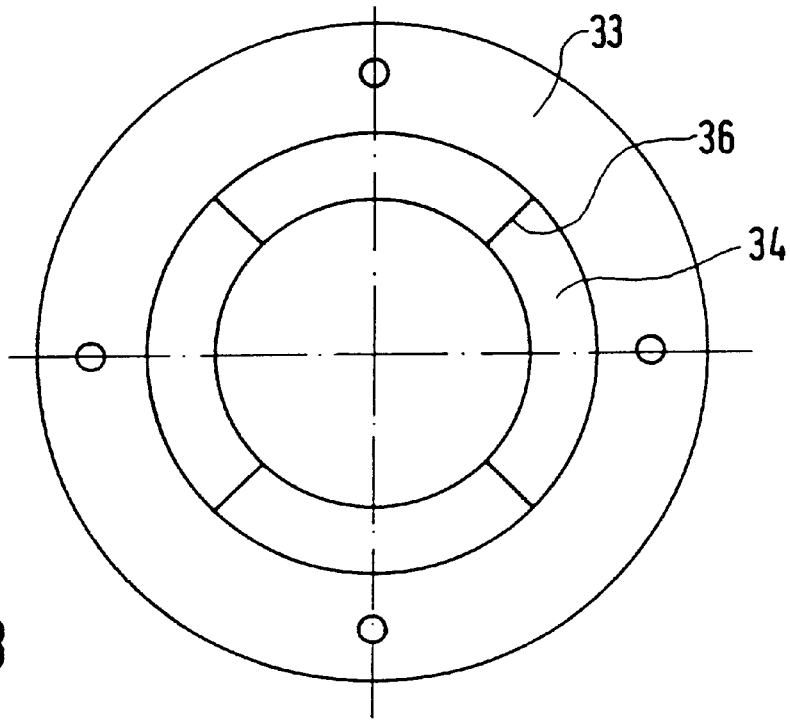
FIG. 3 is another top view according to FIG. 2.

As also shown in FIG. 2, the exemplary embodiment, which is shown to the left of the central axis of the speaker in FIG. 1, is provided with a circular opening 35 in the cap 33, which is disposed rotationally symmetrical to the central axis of the speaker. As also shown in FIG. 3, however, in the exemplary embodiment shown on the right of the central axis of the speaker in FIG. 1, the opening 35 and the sound guidance conduit 34 connected to it are embodied as circular and annular. If one ignores the stiuts 36 that connect the center part 33' of the cap 33 to the rest of the cap 33 in the embodiment according to FIG. 3, in both embodiments according to FIG. 1, the cross sectional area of the openings 35 essentially corresponds to the cross sectional area of the sound guidance conduits 34.

If, as explained further above, the converter 11 is set into oscillations, the membrane 15 moves into the so-called (front) displacement volume 37 with an outward stroke. For an outward stoke of the membrane 15, this displacement volume 37 is provided between the effective membrane diameter, which is calculated from the inside cross section of the membrane 15 on its front side 28 and 2× the half width of the bead 19, the spacer ring 32, and a cap 33 that has no opening 35 for this consideration. It is clear in this connection that the spacer ring 32 or its height parallel to the central axis of the speaker has the task of preventing the membrane 15 or the bead 19 from "striking against" the cap 33. Since a converter 11 having a diameter of 130 mm was used in the current exemplary embodiment, the size of the displacement volume 37 came to only approx. 85 $cm^3$.

The displacement volume 37, which is set into motion by the oscillations of the membrane 15, then sets the volume yielded by the cross section and the length of the respective sound guidance conduit 34 into particularly powerful oscillations, by means of which the particularly favorable bass reproduction is produced in the listening space 38. A prerequisite for this, however, is that the length of the sound guidance conduits 34$\leqq\lambda/8$ of the desired upper cross-over frequency.

Also, a device 10, which is explained in connection with FIGS. 1 to 3, is noncritical with regard to the bass reproduction quality in a large band width in comparison to changes in the volume size of the closed damping volume 30. This means that if a device 10, which is shown in FIGS. 1 to 3, is inserted, for example, into the paneling of a vehicle door and if the closed damping volume 30 is constituted by the paneling and the door covering, (not all shown), components that reduce the closed damping volume 30—e.g. a side collision protection, servomotors for electric window lifters, or particularly thick safety glass—can easily be later integrated into the intermediary space between the door covering and the paneling without disadvantage to the bass reproduction. Even changes to the door shape or door size are regarded as non-critical.

Figure 4:
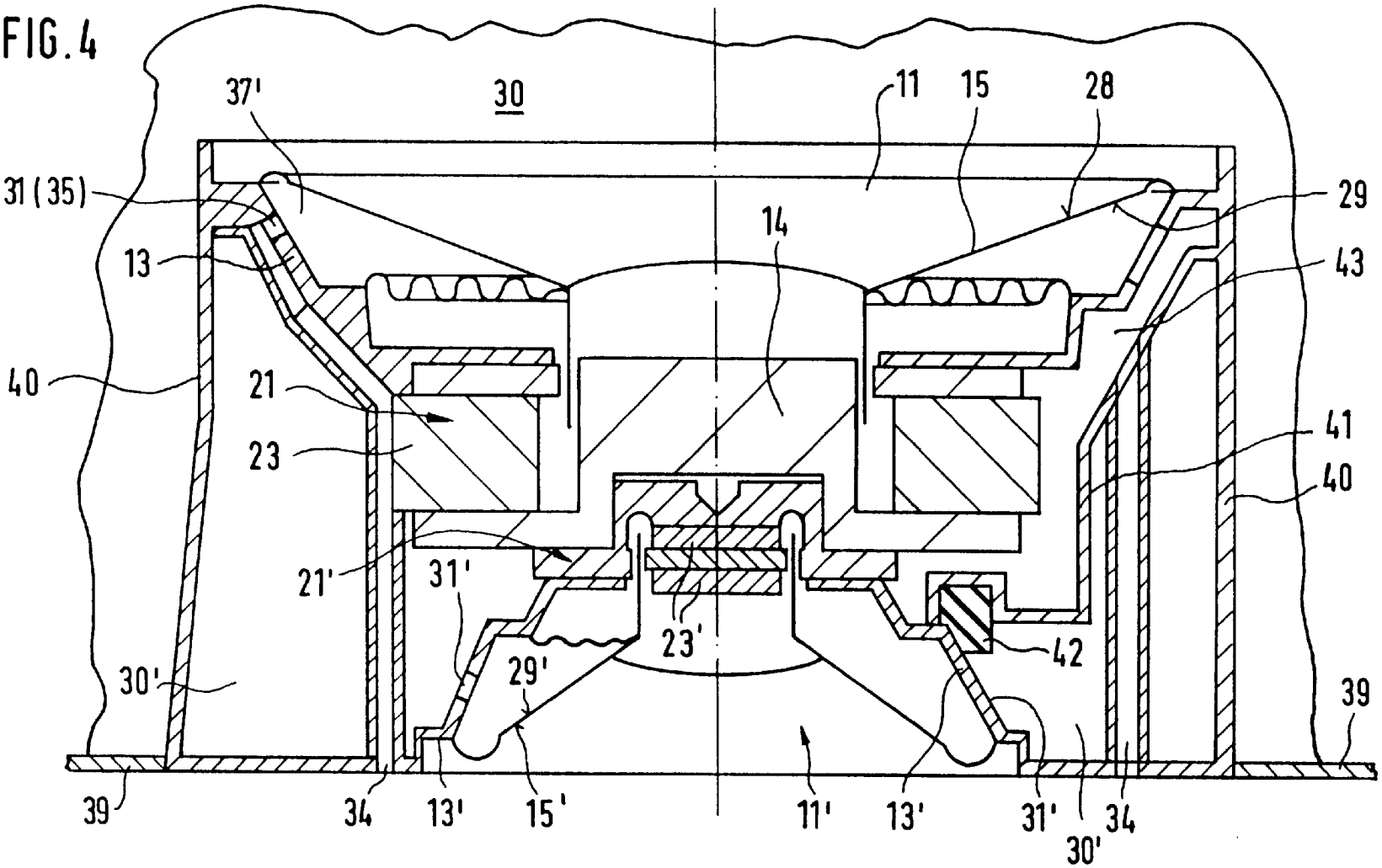
FIG. 4 is a section through another device according to FIG. 1.

Another device 10 is shown in FIG. 4, which in turn has two embodiments as its subject. As long as nothing different is explained, the two embodiments disposed to the right and left of the central axis of the speaker are identical. In function and design, the converter 11 shown in FIG. 4 is largely identical to the converter 11 according to FIG. 1. The only difference is that the converter 11 according to FIG. 4 "works" on the closed damping volume 30 with the front side 28 of the membrane 15. Also in FIG. 4, the closed damping volume 30 is not constituted by a separate housing, but is provided by virtue of the fact that the device 10 is inserted into an installation housing 39; walls 40 must be provided to the device 10, which separate the sound waves emitted by the back side 29 of the membrane 15 from the sound waves emitted by the front side 28 of the membrane 15.

Furthermore in FIG. 4, there is a second converter 11', which essentially has the components that the converter 11 also has. For the sake of clarity, it should be emphasized that the components of the converter 11', which are identical in function to the components of the converter 11, are labeled with the respective reference numerals of the converter 11 and a prime symbol.

In contrast to the converter 11, this converter 11', which is provided for reproducing mid-frequency sounds, is equipped with two permanent magnets 23', which are disposed inside the space edged by the oscillator coil support 16'. In addition, the two converters 11, 11' are connected to each other back-to-back at their magnet systems 21, 21', central to the central axis of the speaker. Furthermore, in order to improve the reproduction quality, the converter 11' has an individual middle sound volume, which constitutes the additional closed damping volume 30' according to this application. In the embodiment shown to the left of the central axis of the speaker, this additional closed damping volume 30', which communicates with the back side 29' of the membrane 15' by way of the through openings 31', is essentially embodied by the wall 40, the holder 13, the magnet systems 21, 21', and the holder 13'. Since the sound guidance conduit 34 shown in FIG. 4 (left side), which passes through the additional closed damping volume 30', is only one of a number of sound guidance conduits 34 disposed radial to the central axis of the speaker, the additional closed damping volume 30' is also bounded by the sound guidance conduits 34.

Clearly, from the embodiment on the left of the central axis of the speaker in FIG. 4, it can be inferred that the rear displacement volume 37' of the converter 11 is connected to the listening space 38 by means of the sound guidance conduits 34 and the through openings 31 in the holder 13, which constitute the openings 35 in this respect. Since the sound guidance conduit(s) 34 are partially constituted by the permanent magnet 23, a favorable heat dissipation from the magnet system 21 (21') is assured.

In the embodiment shown on the right of the central axis of the speaker in FIG. 4, the closed damping volume 30' is constituted by the wall 40, an additional wall 41, the holder 13', and the sound guidance conduit(s) 34, which pass through the closed damping volume 30'. In order to produce the impermeability of the closed damping volume 30', a sealing element 42 is provided between the additional wall 41 and the holder 13'. Since the additional wall 41 extends spaced axially apart from the holder 13 and the magnet system 21 and as a result, an intermediary volume 43 is supplied, whose air volume is in contact with the drive device 14 (21, 21'), a favorable heat dissipation from the drive device 14 is produced by means of this intermediary volume 43, without an expensive routing of the sound guidance conduit(s) 34 being required.

Figure 5:
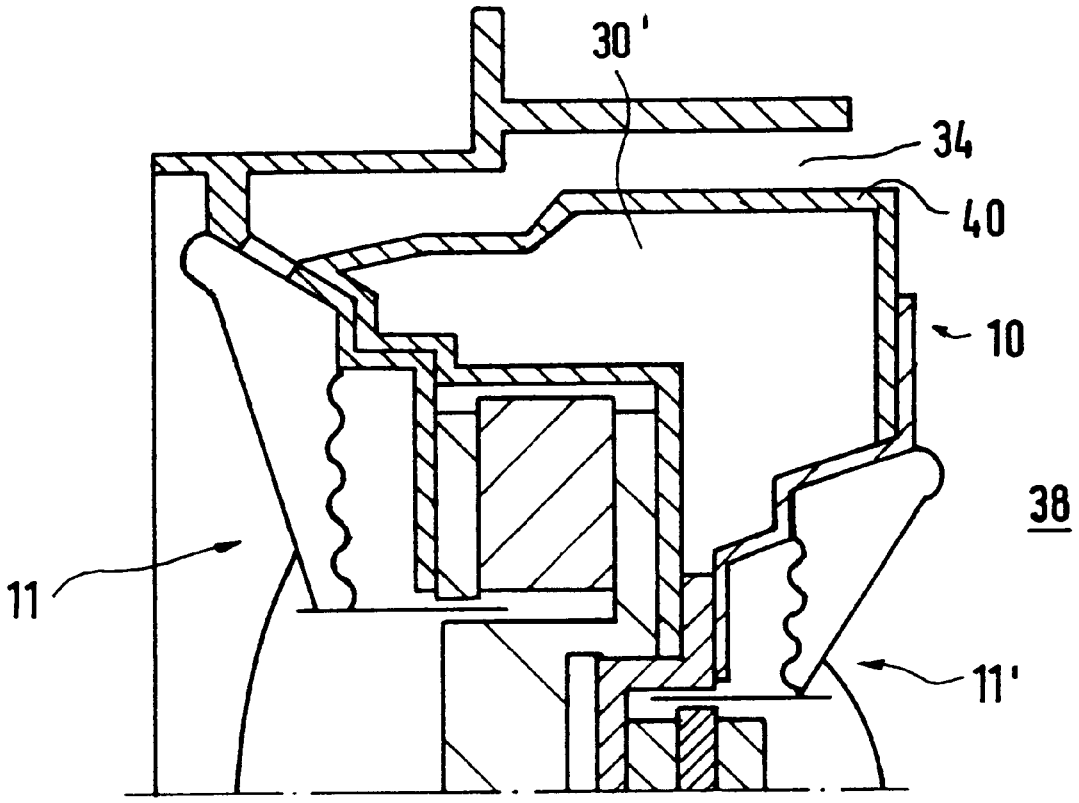
FIG. 5 is a sectional representation of another device.

Another embodiment of the invention is shown in FIG. 5. This embodiment largely corresponds to the embodiments shown in FIG. 4. In contrast to this, however, the sound guidance conduit 34 is not routed through the additional closed damping volume 30', but rather in FIG. 5, the sound guidance conduit 34 adjoins the closed damping volume 30' radially and as a result, uses its wall 40. In the embodiments according to FIGS. 4 and 5, even though converters with conical membranes 15' are shown as the additional converter 11', in this additional exemplary embodiment, not shown, the converter 11 for the bass reproduction can also be combined with a converter that has a spherical membrane. Since as a rule, converters with spherical membranes have a smaller diameter than converters 11' with a conical membrane 15', this produces space advantages on the side of the device 10 oriented toward the listening space 38, because in this instance, since converters with a spherical membrane do not require a separate damping volume 30, the sound guidance conduits 34 can be routed to the listening space 38 with a small spacing from the central axis of the speaker.

What is claimed is:

1. A sound reproduction device comprising;

a first membrane (15) for reproducing low-frequency sounds, the first membrane having a front surface (28) and a rear surface (29), a drive device (14), which drives at least the first membrane (15) and is disposed spaced axially apart from it, fastening means (13) for the reciprocal connection of the first membrane (15) and the drive device (14), a displacement volume (37, 37') which is disposed in front of the front surface (28) or in front of the rear surface (29), a closed damping volume (30), which is constituted by walls of a housing (12) and the first membrane (15), the displacement volume (37, 37'), which adjoins the front surface (28) or the rear surface (29) of the first membrane (15) remote from the damping volume, is closed except for at least one opening (35), the cross sectional area of all of the openings (35) is significantly smaller than the cross sectional area (35) of the first membrane (15), an open sound guidance conduit (34) adjoins each opening (35) and its cross section corresponds essentially to the cross sectional area of the opening (35) to which it is connected; and wherein when there is a deflection of the first membrane (15) to one side, the displacement volume is calculated according to the following formula:

$$\text{displacement volume} <= \text{effective membrane diameter}^3 \times 0.06,$$

and wherein the length of the sound guidance conduit is less than or equal to one-eighth ($\leqq \lambda/8$) of a desired upper cross-over frequency;

and further wherein the sound reproduction device comprises an additional membrane (15') disposed spaced axially apart from the first membrane (15), and wherein the drive device (14), which also drives the additional membrane (15'), is disposed between the two membranes (15, 15').

2. A sound reproduction device according to claim 1, wherein there is an additional closed damping volume (30'), which is constituted by walls (40, 41) of an additional housing and the additional membrane (15').

3. A sound reproduction device according to claim 2, wherein the sound guidance conduit (34) is formed at least partially by the walls (40, 41) of the additional housing.

4. A sound reproduction device according to claim 3, wherein the drive device (14) has wall surfaces which communicate with a gas volume of a listening space (38).

5. A sound reproduction device according to claim 4, wherein the drive device (14) for each of the two membranes (15, 15') has an independent magnet system (21, 21') that has a permanent magnet (23, 23') and a yoke (22), and the two magnet systems (21, 21') are connected to each other back-to-back.

6. A sound reproduction device according to claim 1, wherein the drive device (14) has wall surfaces which communicate with a gas volume of a listening space (38).

7. A sound reproduction device according to claim 1, wherein the drive device (14) for each of the two membranes (15, 15') has an independent magnet system (21, 21') that has a permanent magnet (23, 23') and a yoke (22), and the two magnet systems (21, 21') are connected to each other back-to-back.

8. A sound reproduction device comprising:

a first membrane (15) for reproducing low-frequency sounds, the first membrane having a front surface (28) and a rear surface (29), a drive device (14), which drives at least the first membrane (15) and is disposed spaced axially apart from it, fastening means (13) for the reciprocal connection of the first membrane (15) and the drive device (14), a displacement volume (37, 37') which is disposed in front of the front surface (28) or in front of the rear surface (29), a closed damping volume (30), which is constituted by walls of a housing (12) and the first membrane (15), the displacement volume (37, 37'), which adjoins the front surface (28) or the rear surface (29) of the first membrane (15) remote from the damping volume, is closed except for at least one opening (35), the cross sectional area of all of the openings (35) is significantly smaller than the cross sectional area (35) of the first membrane (15), an open sound guidance conduit (34) adjoins each opening (35) and its cross section corresponds essentially to the cross sectional area of the opening (35) to which it is connected; and an additional membrane (15') disposed spaced axially apart from the first membrane (15), and wherein the drive device (14), which also drives the additional membrane (15'), is disposed between the two membranes (15, 15').

9. A sound reproduction device for confined space applications comprising:

a drive device which drives at least one membrane;

a closed housing comprised of top, bottom, and side walls for mounting said drive device with said membrane within said housing wherein said driving device includes a back wall for mounting said driving device;

said back wall divides said closed housing into a front closed volume and a rear closed damping volume which are not in air contact with each other;

a front displacement volume is located between a front side of said membrane and said top wall;

said top wall has at least one spherical or annular port connected to at least one sound conduit which is external to and adjoining said housing;

the radius of all of said ports is significantly smaller than the radius of said membrane;

the length of said sound conduit is up to one-eighth of a desired upper cross-over frequency ($\frac{1}{8}\lambda$).

10. The device of claim 9, wherein:

the length of said sound conduit in combination with said front displacement volume and a moving mass generated by said drive device forms an acoustic mass which is greater than an acoustic mass formed by a combination of said rear closed damping volume and said housing.

11. A sound reproduction device for confined space applications comprising:

a driving device which drives at least one membrane;

a closed housing comprised of top, bottom, and side walls for mounting said driving device with said membrane within said housing wherein said driving device includes a back wall for mounting said driving device;

said back wall divides said closed housing into a front closed volume and a rear closed damping volume which are not in air contact with each other;

a front displacement volume located between a front side of said membrane and said top wall;

a rear displacement volume located behind said membrane and in front of said backwall;

said rear displacement volume containing a small port which is connected to a sound conduit;

said sound conduit is fed through said backwall and is fed through said rear closed damping volume and exits through said bottom wall wherein said sound conduit is not in air contact with said rear closed damping volume.

* * * * *

UNITED STATES PATENT AND TRADEMARK OFFICE

CERTIFICATE OF CORRECTION

PATENT NO. : 6,212,284 B1
DATED : April 3, 2001
INVENTOR(S) : Bernhard Puls

It is certified that error appears in the above-identified patent and that said Letters Patent is hereby corrected as shown below:

Item [57], ABSTRACT,
Line 14, "≤" should be -- ≤ --.

Column 9,
Line 13, "≤" should be -- ≤ --.

Signed and Sealed this

Eighth Day of January, 2002

*Attest:*

*Attesting Officer*

JAMES E. ROGAN
*Director of the United States Patent and Trademark Office*